US007971302B2

(12) United States Patent
Poy et al.

(10) Patent No.: US 7,971,302 B2
(45) **Date of Patent: *Jul. 5, 2011**

(54) INTEGRATED CONTINUOUS BATCH TUNNEL WASHER

(75) Inventors: Russell H. Poy, New Orleans, LA (US); Karl Schubert, Vossem (BE)

(73) Assignee: Pellerin Milnor Corporation, Kenner, LA (US)

( * ) Notice: Subject to any disclaimer, the term of this patent is extended or adjusted under 35 U.S.C. 154(b) by 20 days.

This patent is subject to a terminal disclaimer.

(21) Appl. No.: 12/400,479

(22) Filed: Mar. 9, 2009

(65) Prior Publication Data

US 2009/0260161 A1 Oct. 22, 2009

Related U.S. Application Data

(60) Provisional application No. 61/046,120, filed on Apr. 18, 2008.

(51) Int. Cl.
*D06F 29/02* (2006.01)

(52) U.S. Cl. ..... 8/158; 8/159; 8/137; 8/147

(58) Field of Classification Search ..... 8/115.6, 8/158, 159, 147

See application file for complete search history.

(56) References Cited

U.S. PATENT DOCUMENTS

| | | | | |
|---|---|---|---|---|
| 1,686,313 | A * | 10/1928 | Dreher et al. | 118/52 |
| 3,722,233 | A * | 3/1973 | Windhorst | 68/5 D |
| 4,236,393 | A | 12/1980 | Katzfey | |
| 4,479,370 | A * | 10/1984 | Wang | 68/22 R |
| 4,485,509 | A | 12/1984 | Pellerin et al. | |
| 4,522,046 | A | 6/1985 | Dreher | |
| 4,546,511 | A | 10/1985 | Kaufmann | |
| 4,694,665 | A * | 9/1987 | Stoll | 68/27 |
| 5,211,039 | A | 5/1993 | Pellerin | |
| 5,454,237 | A | 10/1995 | Pellerin | |
| 2002/0116770 | A1 | 8/2002 | Mehrmann et al. | |
| 2003/0110815 | A1 | 6/2003 | Poy | |

FOREIGN PATENT DOCUMENTS

| | | |
|---|---|---|
| JP | 07-000674 | 1/1995 |
| JP | 2004-538112 | 12/2004 |

OTHER PUBLICATIONS

Copending U.S. Appl. No. 12/400,497 to Poy et al.*

* cited by examiner

*Primary Examiner* — Harold Y Pyon
*Assistant Examiner* — Katie Hammer
(74) *Attorney, Agent, or Firm* — Garvey, Smith, Nehrbass & North, L.L.C.; Charles C. Garvey, Jr.; Vanessa M. D'Souza

(57) ABSTRACT

A method of washing fabric articles in a tunnel washer includes moving the fabric articles from the intake of the washer to the discharge of the washer through first and second sectors that are a pre-wash zone. In the pre-wash zone, liquid is counter flowed in the wash interior along a flow path that is generally opposite the direction of travel of the fabric articles. The fabric articles are transferred to a main wash zone, and a washing chemical is added to the main wash zone. At about the same time, counter flow is reduced or stopped. The main wash zone can be heated as an option. After a period of time (for example, between about 20 and 120 seconds) counter flow is increased. The increased counter flow after chemical treatment amounts to either an intermediate rinse or a pre-rinse depending upon which module or zone the goods occupy. The pre-rinse ensures that the fabric articles are substantially free of soil or the majority of any soil when they are transferred to an extractor for final removal of excess water.

38 Claims, 7 Drawing Sheets

INTEGRATED CONTINUOUS BATCH TUNNEL WASHER

CROSS-REFERENCE TO RELATED APPLICATIONS

Priority of U.S. Provisional Patent Application Ser. No. 61/046,120, filed Apr. 18, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to continuous batch washers or tunnel washers. More particularly, the present invention relates to an improved method of washing textiles or fabric articles (e.g. clothing, linen, etc.) in a continuous batch tunnel washer wherein the textiles are moved sequentially from one module or zone to the next module or zone including initial pre-wash zones, a plurality of main wash zones, a pre-rinse zone, and then transferred to an extractor that performs the final rinse and that removes water. More particularly, the present invention relates to an improved method of washing textiles in a continuous batch tunnel washer wherein a counter flow of wash liquor from one module or zone to the next module or zone is stopped, allowing for a standing bath. Chemicals are then added to separate soil from the goods and suspend the soil in the wash liquor. After a period of time, counter flow is commenced again to remove the suspended soil.

2. General Background of the Invention

Currently, washing in a commercial environment is conducted with a continuous batch tunnel washer. Such continuous batch tunnel washers are known (e.g. U.S. Pat. No. 5,454,237) and are commercially available (www.milnor.com). There are also machines that do not counterflow. Continuous batch washers have multiple sectors, zones, stages, or modules including pre-wash, wash, rinse and finishing zone. Commercial continuous batch washing machines utilize a constant counter flow of liquor and a centrifugal extractor or mechanical press for removing most of the liquor from the goods before the goods are dried.

Currently, a counter flow is used during the entire time that the fabric articles or textiles are in the main wash module zone. This practice dilutes the washing chemical and reduces its effectiveness. Additionally, while the bath liquor is being heated, this thermal energy is partially carried away by the counter flow thus wasting energy while a desired temperature value is achieved.

A final rinse with any continuous batch washer is sometimes performed using a centrifugal extractor or mechanical press. In prior art systems, if centrifugal extraction is used, it is typically necessary to rotate the extractor at a first low speed that is designed to remove soil laden water before a final extract.

Patents have issued that are directed to batch washers, tunnel washers, rinsing schemes and the like. The following table provides examples.

TABLE

| PAT. NO. | TITLE | ISSUE DATE |
|---|---|---|
| 4,236,393 | Continuous tunnel batch washer | Dec. 02, 1980 |
| 4,485,509 | Continuous batch type washing machine and method for operating same | Dec. 04, 1984 |
| 4,522,046 | Continuous batch laundry system | Jun. 11, 1985 |
| 5,211,039 | Continuous batch type washing machine | May 18, 1993 |
| 5,454,237 | Continuous batch type washing machine | Oct. 03, 1995 |

BRIEF SUMMARY OF THE INVENTION

The present invention improves the current art by reducing water consumption, improving rinsing capability, reducing the number of components required to perform the function of laundering fabric articles or textiles, and saving valuable floor space in the laundry.

The present invention reduces and/or combines zones, sectors, or modules and improves the method of processing the textiles. Rinsing is done in two zones, first in the continuous batch washer itself in a pre-rinse zone after the main wash. A final rinse is then done in a mechanical water removal machine such as a centrifugal extractor or mechanical press.

When the goods are initially transferred into the main wash modules, the counter flow of wash liquor into the modules is stopped allowing for a standing bath. Chemicals are added to separate the soil from the goods and suspend the soil in the wash liquor. If needed, the wash liquor to the separate module bath is raised in temperature to facilitate the release of soil from the goods and activate the chemicals.

Once the soil has been released from the textiles, there is no more work for the chemicals to perform. At this time, the process can be described as chemical equilibrium. At this point, water by counter flow is commenced to remove the suspended soil. This could be termed an intermediate rinse since the water counter flowing into the module or zone is cleaner than what is counter flowing out of the module or zone. When the goods have progressed in this manner through the tunnel to a point where no more wash chemicals are needed, then the water flowing into the module or zone begins the rinsing process. This rinsing is termed pre-rinse. A final rinse can be performed in a centrifugal extractor or mechanical press.

The process of the present invention uses fresh water in the extractor that can be supplied through an atomizing nozzle while the goods are being extracted at high speed (e.g. between about 200-1,000 g's). Because the free soil has already been removed in the pre-rinse zone, the spray rinse while extracting will not re-deposit soil on the linen thereby reducing or eliminating graying of the goods. It is not necessary to centrifuge (and drain at a low speed) the free water before the final extract. With the present invention the process time is reduced. The amount of fresh water required compared with conventional processes is reduced.

The method of the present invention uses less water than in current art because the counter flow throughout the wash and rinse modules or zones is stopped for part of the cycle. The spray rinse in the centrifugal extractor or mechanical press is more effective than the current practice of draining the free water from the linen and then refilling.

The method of the present invention preserves the washing effectiveness of current counter flow washers to wash heavy soil classifications because the amount of soil dilution is the same even though there are less zones, stages, or modules. The present invention provides a higher effective rinsing provided by the spray rinse in the centrifugal extractor because of the pre-rinse in the tunnel washer.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
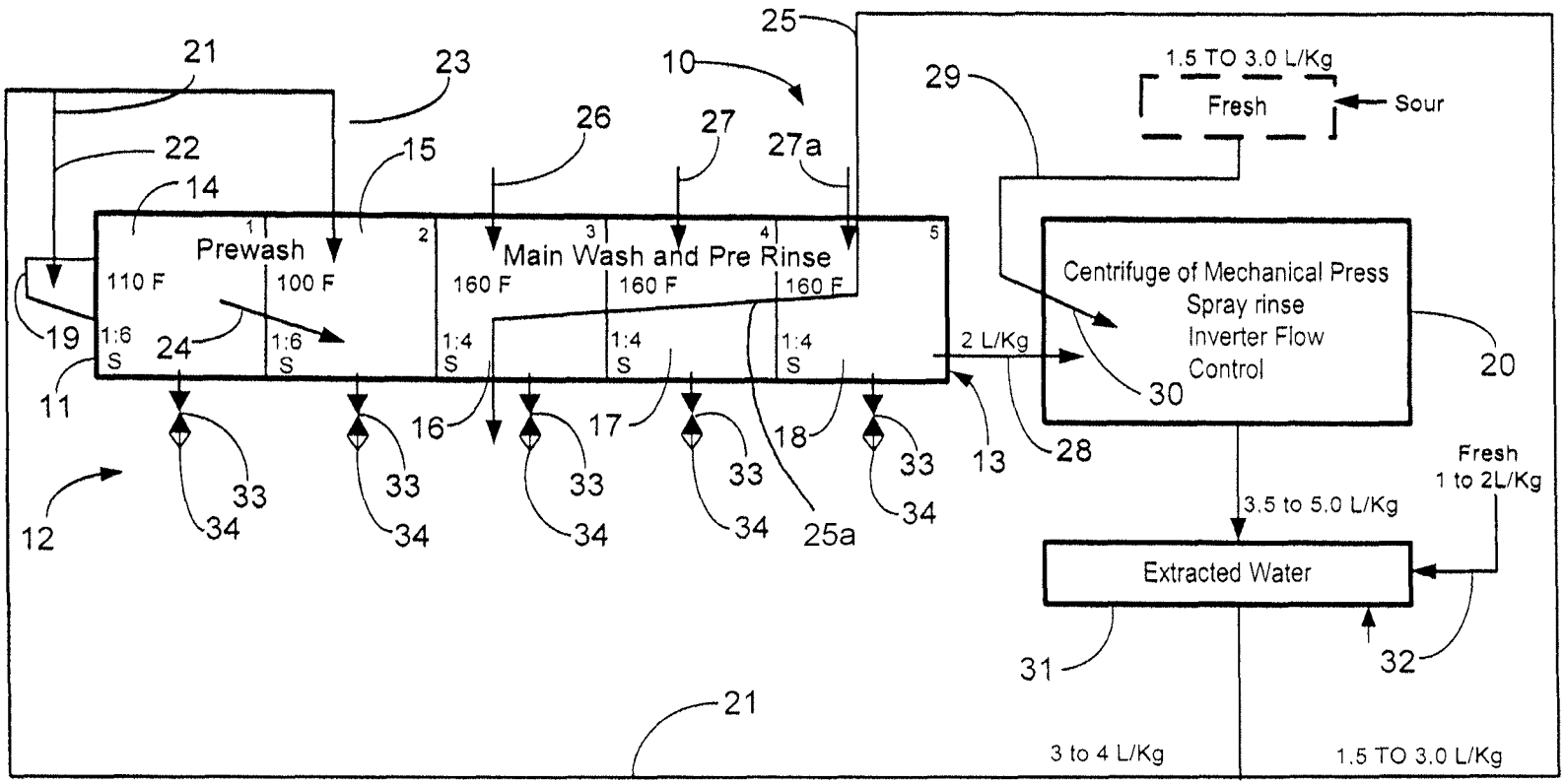
FIG. 1 is a schematic diagram showing the preferred embodiment of the apparatus of the present invention.
Figure 2:
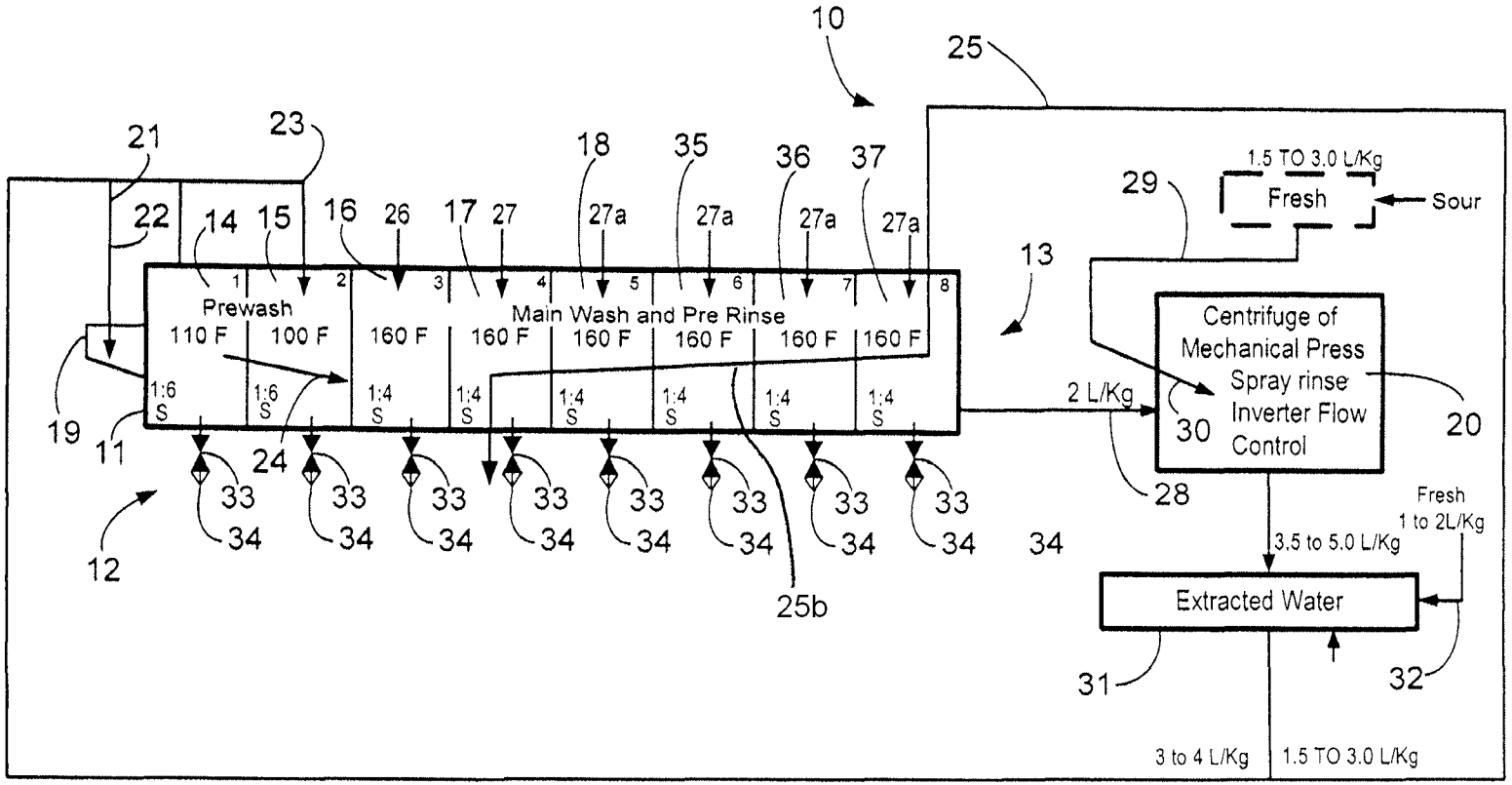
FIG. 2 is a schematic diagram showing the preferred embodiment of the apparatus of the present invention.
Figure 3:
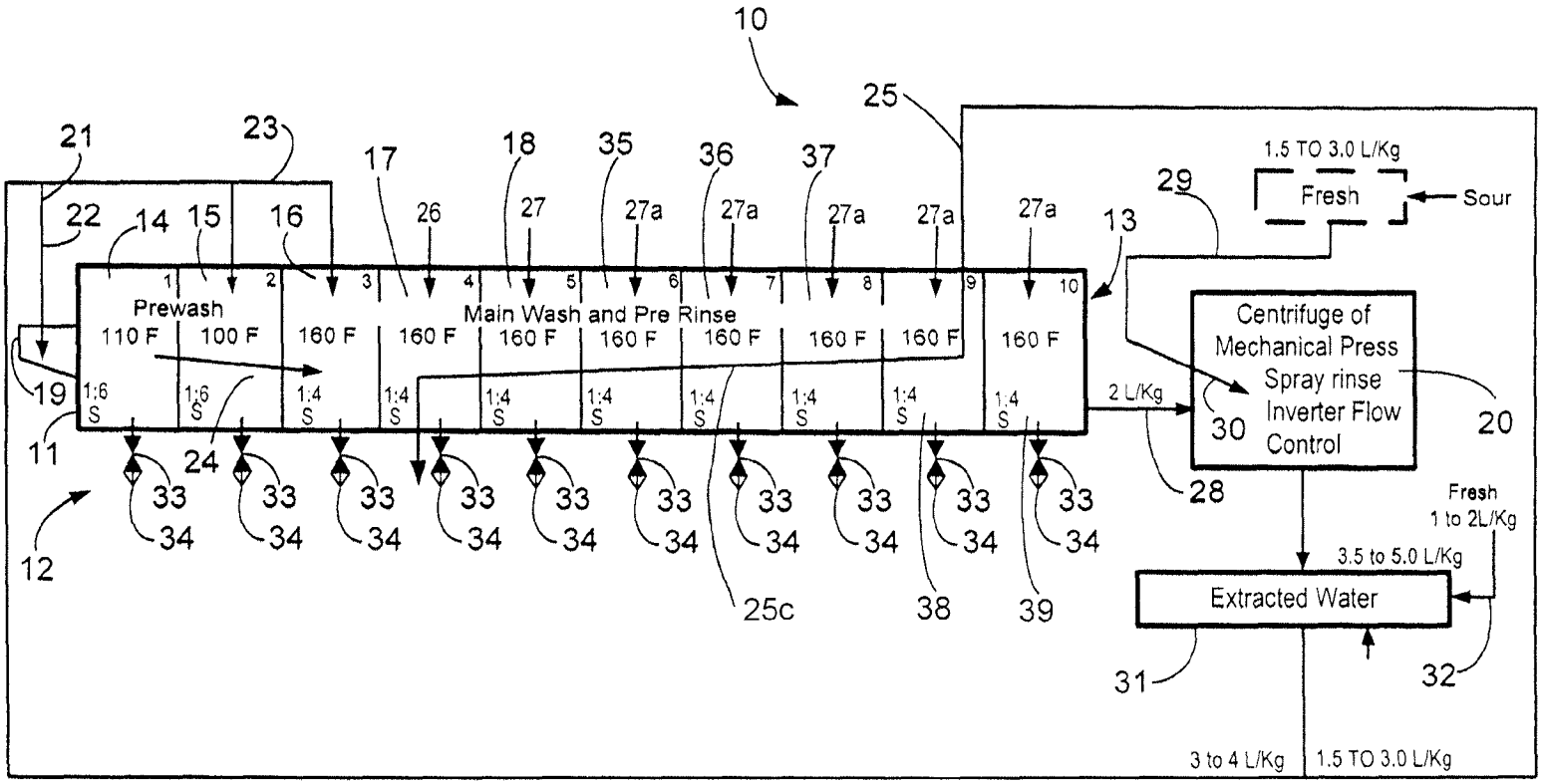
FIG. 3 is a schematic diagram showing the preferred embodiment of the apparatus of the present invention.

FIGS. 1-3 show schematic diagrams of the textile washing apparatus of the present invention, designated generally by the numeral 10. Textile washing apparatus 10 provides a tunnel washer 11 having an inlet end portion 12 and an outlet end portion 13. Tunnel washer 11 provides a number of modules such as the modules 14-18 shown in FIG. 1. These modules 14-18 can include a first module 14 and a second module 15 which can be pre-wash modules. The plurality of modules 14-18 can also include modules 16, 17 and 18 which are main wash and pre-rinse modules.

The total number of modules 14-18 can be more or less than the five (5) shown in FIG. 1. FIG. 2 shows an alternate arrangement that employs a tunnel washer 11 having eight (8) modules 14-18 and 35-37. FIG. 3 shows an alternate arrangement that employs a tunnel washer 11 having ten (10) modules 14-18 and 35-39. In FIG. 2, the modules 14, 15 can be pre-wash modules. In FIG. 3, modules 14, 15, 16 can be pre-wash modules. In FIG. 2, the modules 16, 17, 18 and 35, 36, 37 can be main wash and pre-rinse modules. In FIG. 3, the modules 17, 18 and 35, 36, 37, 38, 39 can be main wash and pre-rinse modules. Instead of a two (2) or three (3) module pre-wash section (see FIGS. 1, 2, 3), a single module 14 could be provided as an alternate option for the pre-wash section.

Inlet end portion 12 can provide a hopper 19 that enables the intake of textiles or fabric articles to be washed. Such fabric articles, textiles, goods to be washed can include clothing, linens, towels, and the like. An extractor 20 is positioned next to the outlet end portion 13 of tunnel washer 11. Flow lines 21, 25, 26, 27, 27A are provided for adding water and/or chemicals to tunnel washer 11 at selected or desired locations.

When the fabric articles, goods, linens are initially transferred into the main wash modules 16, 17, 18, a counter flow of wash liquor into these modules 16, 17, 18 is stopped allowing for a standing bath. In FIG. 1, chemicals are then added as indicated by arrows 26, 27 and 27A to the modules 16, 17 and/or 18. In FIG. 2, chemicals are added as indicated by arrows 26, 27, 27A to the modules 16, 17, 18, 35, 36 and/or 37. In FIG. 3, chemicals are added to the modules 16-18 and 35-39 as indicated by the arrows 26, 27, 27A. In each arrangement of FIGS. 1-3, these chemicals separate the soil from the goods, linens or textiles and suspend the soil in the wash liquor. During this step of the method of the present invention, the wash liquor temperature can be elevated if needed to facilitate the release of soil from the goods, fabric articles or linens and activate the chemicals.

Once the maximum soil has been released from the textiles or fabric articles in each module, there is no more work for those chemicals to perform. At this time, the process can be described as chemical equilibrium. The flow of water is stopped for a time period sufficient to release soil from the goods such as for example between about twenty (20) seconds and one hundred twenty (120) seconds. However, this time interval can be between about ten (10) and three hundred (300) seconds.

After this time interval of having no counter flow, water by counter flow is commenced to remove the suspended soil. If more wash chemicals are to be added, then this counter flow can be termed intermediate rinse. Once the goods reach the module or zone where no more wash chemicals are added, then the counter flow can be termed pre-rinse. A final rinse is then performed in a centrifugal extractor or mechanical press 20. The process of the present invention uses fresh water in the extractor that can be supplied via flow line 29 through an atomizing nozzle, for example while the goods are being extracted at high speed (e.g. between about 200 and 1,000 g's) using the extractor 20.

Flow line 21 transmits water to hopper 19 as indicated by arrow 22. Flow line 21 also carries water to pre-wash module 15 as indicated by arrow 23. Arrow 24 indicates a flow of water from module 14 to module 15 as part of the pre-wash.

In FIG. 1, flow line 25 adds water for counter flow pre-rinse to module 18. Such water added via flow line 25 to module 18 flows in counter flow fashion from module 18 to module 17 to module 16 (see arrow 25A). Arrows 26 and 27 indicate chemical addition to modules 16 and 17 respectively. Chemicals to be added to modules 16 and 17 and can include detergent, alkali and/or oxidizing agents as examples.

In FIG. 2, flow line 25 adds water for counter flow pre-rinse to module 37. Such water added via flow line 25 to module 37 flows in counter flow fashion from module 37 to module 36, then 35, then 18, then to module 17 (see arrow 25B in FIG. 2).

In FIG. 3, flow line 25 adds water for counter flow pre-rinse to module 38. Such water added via flow line 25 to module 38 flows in counter flow fashion from module 38 to module 37, module 36, module 35, module 18, and module 17 (see arrow 25C).

In FIG. 1, textiles or fabric articles that are pre-washed, washed, and then pre-rinsed in tunnel washer 11 are transferred from module 18 to extractor 20 as indicated schematically by arrow 28. In FIG. 2, the textiles or fabric articles that are pre-washed, washed, and then pre-rinsed in tunnel washer 11 are transferred from module 37 to extractor 20 as indicated schematically by arrow 28. In FIG. 3, textiles or fabric articles that are pre-washed, washed, and then pre-rinsed in tunnel washer 11 are transferred from module 39 to extractor 20 as indicated schematically by arrow 28.

The method of the present invention thus conducts rinsing in two zones. Rinsing is first conducted in the tunnel washer 11 in a pre-rinse zone which occurs after the main wash. In FIG. 1, pre-wash zones can be 14, 15. The pre-rinse zone and main wash zone can be modules 16, 17, 18. In FIG. 2, the pre-wash zone can be modules 14 and 15 while the main wash and pre-rinse zones can be modules 16, 17, 18, 35, 36 and 37. In FIG. 3, the pre-wash zone can be modules 14, 15 and 16 while the main wash and pre-rinse zones can be modules 17, 18, 35, 36, 37, 38 and 39. The second rinse zone is the final rinse, which is conducted in the extractor 20 or other mechanical water removal machine such as a mechanical press.

Because the free soil has already been removed in the pre-rinse zone at modules 16, 17, 18 of FIG. 1 (or 16-18, 35-37 of FIG. 2 or 16-18, 35-39 of FIG. 3) as part of the method of the present invention, the spray rinse while extracting at high speed (between about 200-1,000 g's) will not redeposit soil on the linen thereby reducing or eliminating graying of the goods. With the present invention it is not necessary to centrifuge (and drain at a low speed) the free water before the final extract at 20. With the present invention, the process time is thus reduced. The amount of fresh water required compared with conventional processes is reduced. The spray rinse and the centrifugal extractor 20 or mechanical press is more effective than the current practice of draining the free water from the linen and then refilling the extractor 20.

An additional benefit of the pre-rinse concept of the present invention is to permit the mechanical press or extractor to have more time extracting the free water. This result follows because the effect of the pre-rinse is to remove most of the suspended soil. The amount of fresh water required for final rinse is thus greatly reduced. The time for rinsing is reduced, allowing this saved cycle time for water removal.

The method of the present invention preserves the washing effectiveness of current counter flow washers 11 to wash heavy soil classifications because the amount of soil dilution is the same even though there are fewer zones or stages or modules.

The present invention provides a higher effective rinsing provided by the spray rinse (arrow 30). Water is supplied by tank 43. Spray water flows via flow line 29 and is sprayed via a nozzle at 30 into the centrifugal extractor 20. A higher effective rinsing is provided because of the intermediate and pre-rinse that is conducted in the modules 16, 17, 18 as discussed above in FIG. 1, and the additional modules as discussed above for FIGS. 2 and 3.

Outlet valves 33 can be provided on each module 14-18, 35-39 for each FIGS. 1, 2, 3 enabling any of the modules 14-18 or 35-39 to be drained as indicated by arrows 34. Extracted water 31 can be added to water flow line 21. Extracted water 31 can be supplemented with fresh water via flow line 32.

Figure 4:
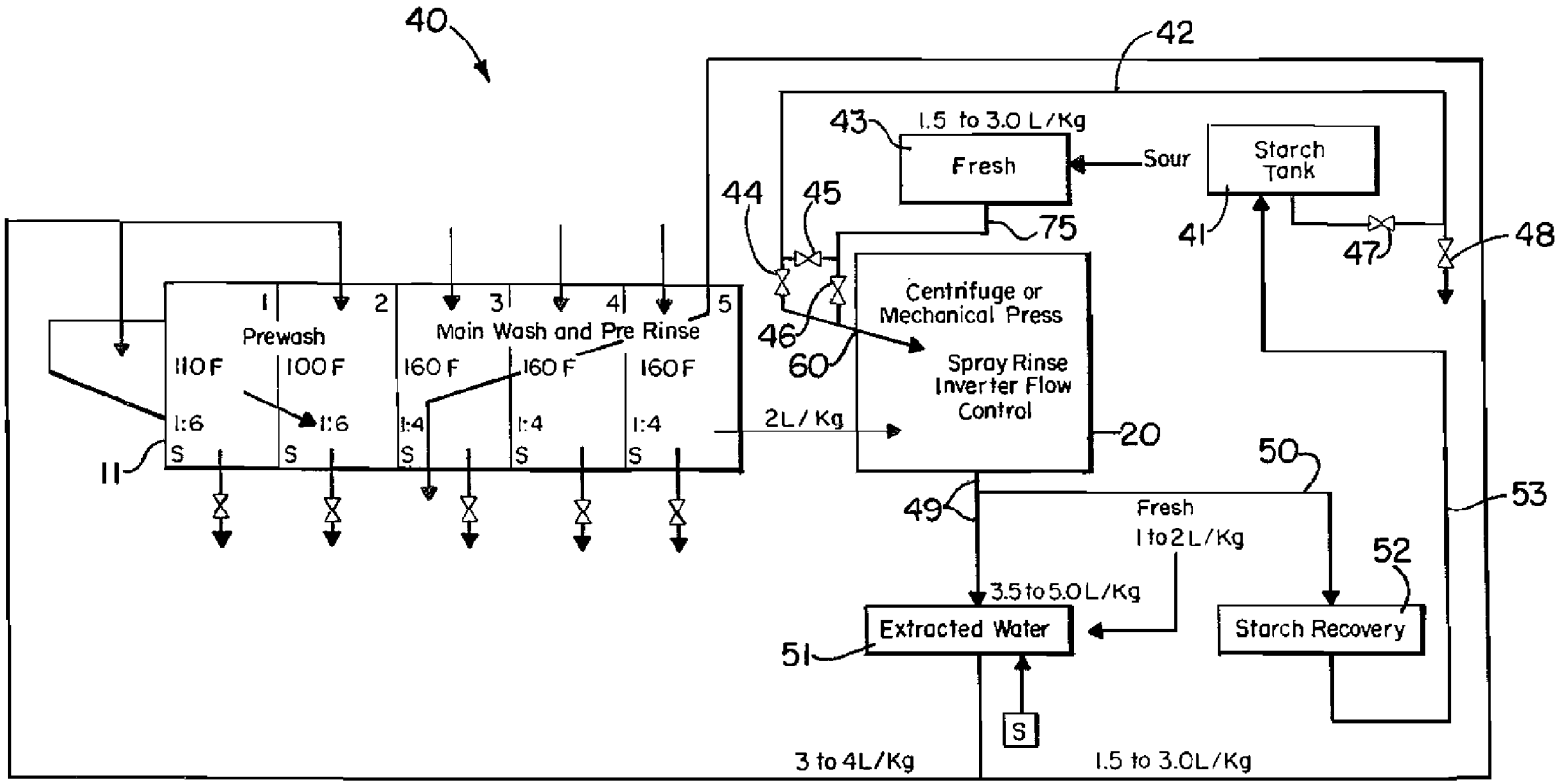
FIG. 4 is a schematic diagram of an alternate embodiment of the apparatus of the present invention.

FIGS. 4-10 show an alternate embodiment of the apparatus of the present invention, designated generally by the numeral 40. The textile washing apparatus 40 of the alternate embodiment can provide the same tunnel washer 11 of the preferred embodiment having the modules 14-18, 35-39 provided in any one of the embodiments of FIG. 1, 2 or 3. FIG. 4 shows the embodiment of FIG. 1 having a specially configured starch spray arrangement.

In FIG. 4, a starch tank 41 contains starch that is to be injected into the linen, fabric articles, or clothing contained in extractor 20. Starch for the table linen, clothing, fabric articles is pumped in the first phase of the cycle through a spray nozzle 60 (see FIGS. 8-10). Controlled flow metering can be achieved for example using an inverter controlled flow metering device. The precise amount of starch is thus injected into the linen, fabric articles, clothing or the like while in extractor 20. Excess starch can be removed in a separate tank indicated as starch recovery tank 52 in FIG. 4. Flow line 53 enables recovered starch in tank 52 to be transferred to starch tank 41.

Starch tank 41 contains starch that is to be pumped via flow line 42 to nozzle 60 and then to extractor 20. Fresh water tank 43 can also be used to pipe fresh water to extractor 20, flowing through valve 45 to nozzle 60. Valves 44, 45 and 46 are provided for controlling the flow of either starch or fresh water or a combination thereof to nozzle 60 as shown in FIG. 4.

Flow line 49 is a flow line that carries extracted water to tank 51 as it is purged from the fabric articles, clothing or linens contained in extractor 20. Starch can be recovered via flow lines 49, 50 to starch recovery tank 52. Valves 44, 47 are provided for valving the flow of starch from tank 41 to extractor 20 via flow line 42. Valve 48 enables tank 41 to be emptied for cleaning or adding new starch.

Figure 8:
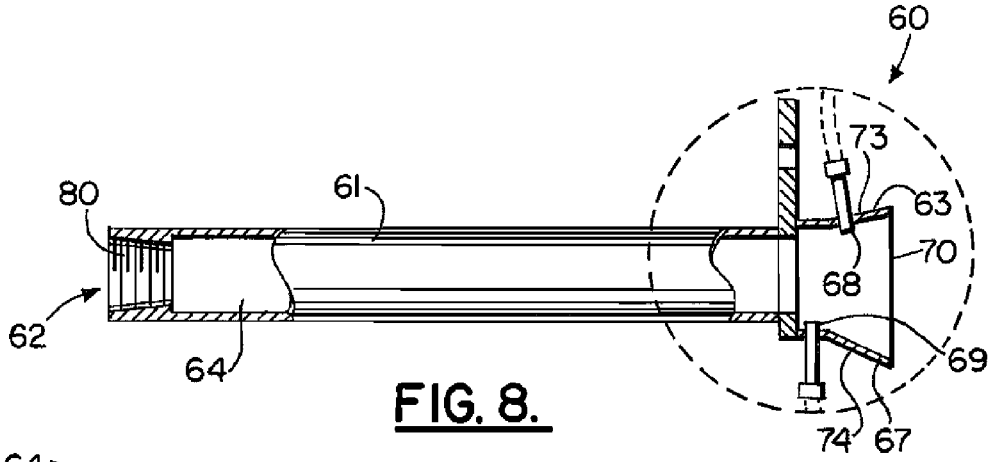
FIG. 8 is a fragmentary perspective view of the alternate embodiment of the apparatus of the present invention showing the starch dispensing nozzle tube.
Figure 9:
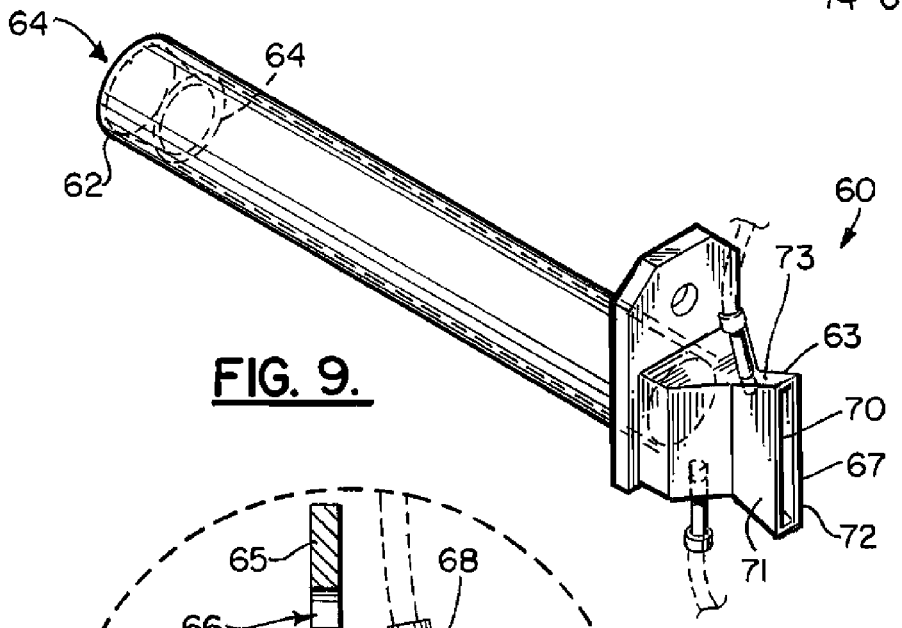
FIG. 9 is a fragmentary perspective view of the alternate embodiment of the apparatus of the present invention showing the starch dispensing nozzle tube.
Figure 10:
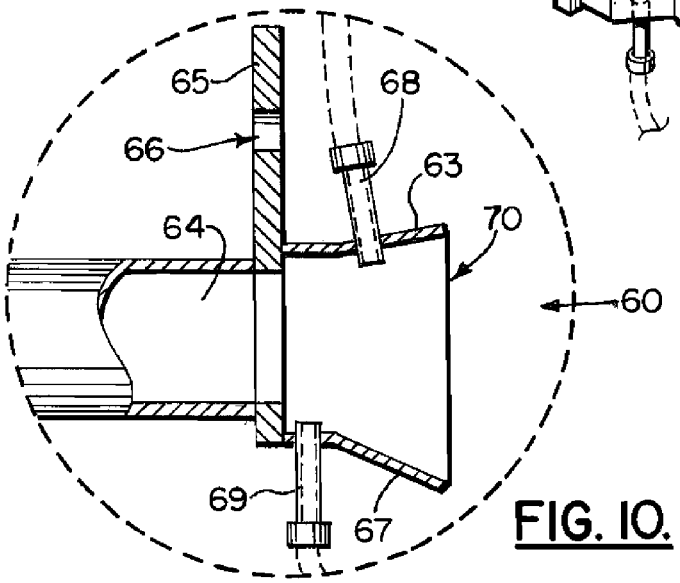
FIG. 10 is a fragmentary perspective view of the alternate embodiment of the apparatus of the present invention showing the starch dispensing nozzle tube.

In FIGS. 8-10, starch spray nozzle 60 is shown in more detail. The spray nozzle 60 can provide an elongated section of conduit or pipe 61. Spray nozzle 60 has an influent end 62 and a discharge end portion 63. Conduit 61 provides an open ended bore 64 for conveying starch from flow line 42 to nozzle 60. Influent end 62 provides a connection 80 for attaching conduit 61 to flow line 42.

Figure 5:
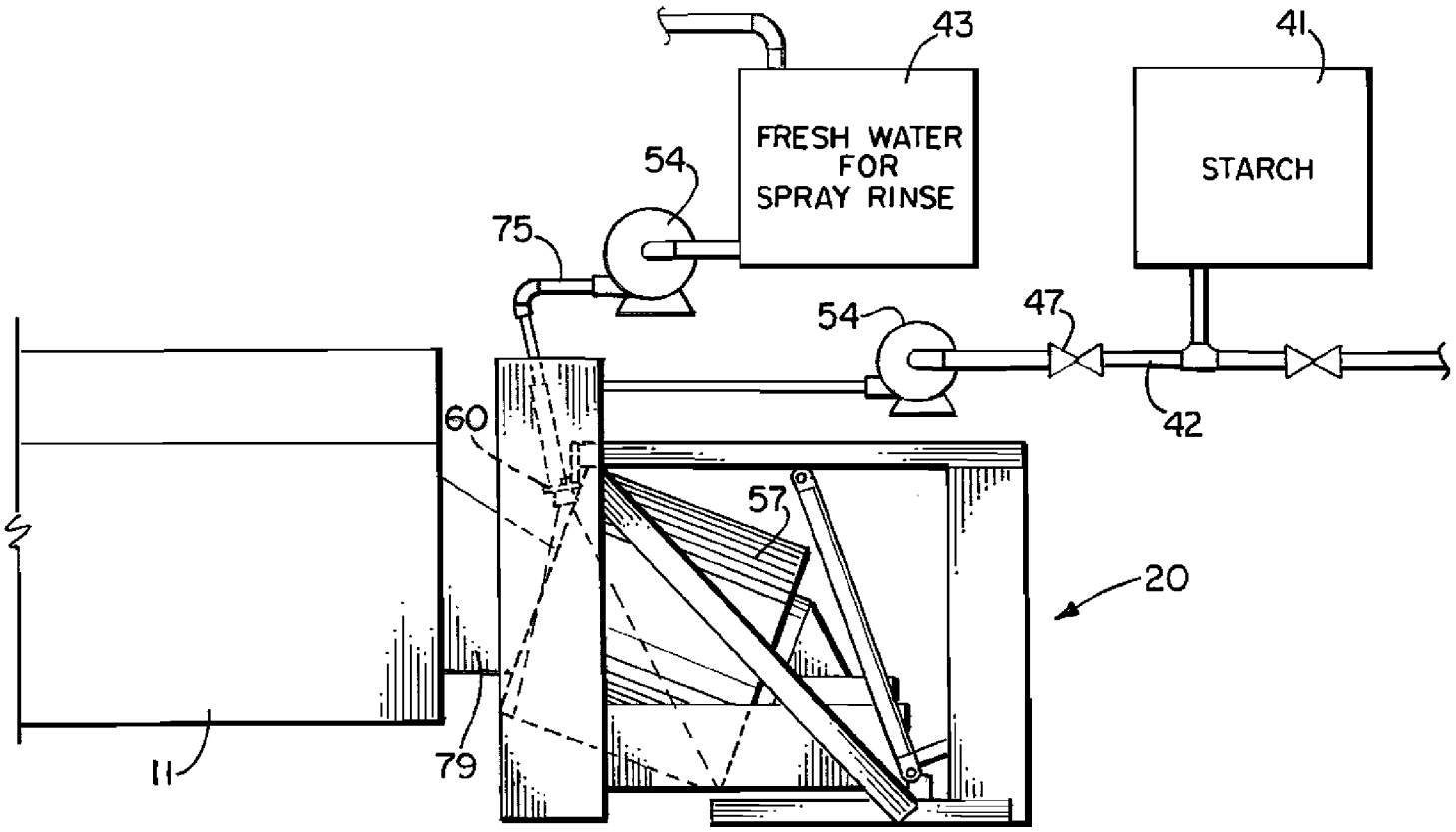
FIG. 5 is a schematic diagram of the alternate embodiment of the apparatus of the present invention.
Figure 7:
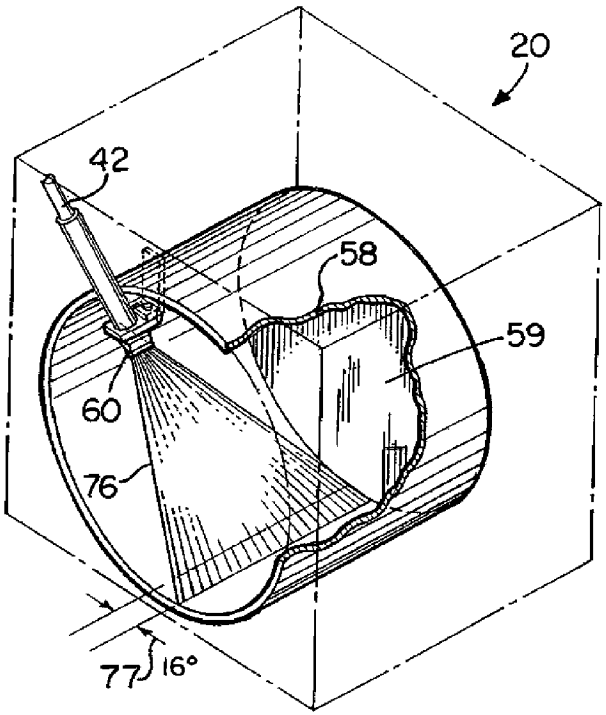
FIG. 7 is a partial perspective view of the preferred embodiment of the apparatus of the present invention.
Figure 6:
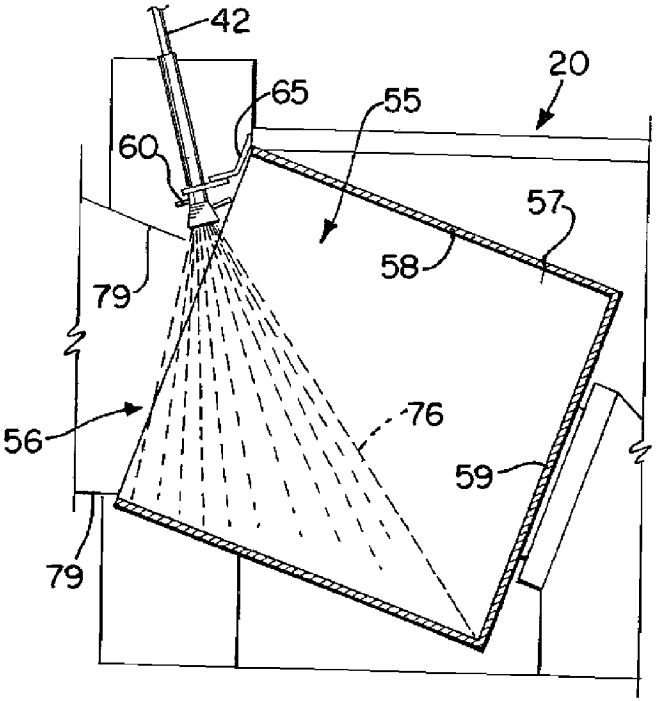
FIG. 6 is a partial perspective view of the alternate embodiment of the apparatus of the present invention.

FIGS. 5-7 illustrate the spray pattern 76 that strikes the wall of drum 57 of extractor 20 as emitted by nozzle 60. In FIGS. 6 and 7, extractor 20 provides a drum 57 that provides a chamber 55 having an inlet 56. Clothes, textiles, linens to be sprayed are discharged from tunnel washer 11 via chute 79 into the chamber 55 of extractor 20. The extractor 20 is preferably movable between a loading and discharging position. The loading position is shown in FIGS. 5 and 6. In the loading position, clothes transfer from the tunnel washer 11 to the chamber 55 via chute 79. Pumps 54 can be used to aid in the transfer of water from tank 43 or starch from tank 41 into chamber 55 via nozzle 60. The spray nozzle 60 produces a spray pattern 76 that extends substantially across the cylindrical wall 58 of drum 57 as shown in FIGS. 6 and 7. Drum 57 thus provides an inlet 56 for enabling clothing, textiles, or other fabric articles to be added to the drum 57 interior 55 and a rear circular wall 59. Notice in FIGS. 6 and 7 that the spray pattern 76 extends generally from inlet 56 to circular wall 59, thus extending substantially across cylindric wall 58 as shown in FIGS. 6 and 7. Arrow 77 in FIG. 7 illustrates the width of spray pattern 76 which can be about 16 degrees as an example along cylindrical drum wall 58.

A mounting plate 65 can be provided having one or more openings 66 for attaching (for example, bolting) spray nozzle 60 to extractor 20 or to a frame that supports extractor 20.

The discharge end portion 63 of spray nozzle 60 provides a nozzle tip 67. The nozzle tip 67 provides a nozzle outlet 70 formed by side plates 71, 72, upper plate 73 and lower plate 74. Atomizing water nozzle 68, 69 are provided next to nozzle outlet 70. The atomizing water nozzle 68 is mounted to upper plate 73. The atomizing water nozzle 69 is mounted to lower plate 74 as shown in FIGS. 8-10. Spray nozzle 60 can be equipped with aerating or atomizing nozzles 68, 69 to control the consistency of the starch in the nozzle 60, thus preventing starch build-up which might eventually plug of the nozzle 60.

As part of the method of the present invention, all starch flow lines 42, 60 can be purged with hot water from fresh water tank via flow line 75.

The following is a list of parts and materials suitable for use in the present invention.

PARTS LIST

| Part Number | Description |
|---|---|
| 10 | textile washing apparatus |
| 11 | tunnel washer |
| 12 | inlet end portion |
| 13 | outlet end portion |
| 14 | module |
| 15 | module |
| 16 | module |
| 17 | module |
| 18 | module |
| 19 | hopper |
| 20 | extractor |
| 21 | flow line |
| 22 | arrow |
| 23 | arrow |
| 24 | arrow |
| 25 | flow line |
| 25A | arrow |
| 25B | arrow |
| 25C | arrow |
| 26 | arrow - chemical addition |
| 27 | arrow - chemical addition |
| 27A | arrow - chemical addition |
| 28 | arrow - textile transfer |
| 29 | spray rinse flow line |
| 30 | arrow |
| 31 | extracted water |
| 32 | flow line |
| 33 | outlet valve |
| 34 | arrow |
| 35 | module |
| 36 | module |
| 37 | module |
| 38 | module |
| 39 | module |
| 40 | textile washing apparatus |
| 41 | starch tank |
| 42 | flow line |
| 43 | fresh water tank |
| 44 | valve |
| 45 | valve |
| 46 | valve |
| 47 | valve |
| 48 | valve |
| 49 | flow line |
| 50 | flow line |
| 51 | extracted water tank |
| 52 | starch recovery tank |
| 53 | flow line |
| 54 | pump |
| 55 | chamber |
| 56 | inlet |
| 57 | drum |
| 58 | cylindrical drum wall |
| 59 | circular drum wall |
| 60 | spray nozzle |
| 61 | conduit |
| 62 | influent end |
| 63 | discharge end |
| 64 | bore |
| 65 | mounting plate |
| 66 | opening |
| 67 | nozzle tip |
| 68 | atomizing water nozzle |
| 69 | atomizing water nozzle |
| 70 | nozzle outlet |
| 71 | side plate |
| 72 | side plate |
| 73 | upper plate |

-continued

PARTS LIST

| Part Number | Description |
|---|---|
| 74 | lower plate |
| 75 | flow line |
| 76 | spray pattern |
| 77 | arrow |
| 78 | drum moving mechanism |
| 79 | chute |
| 80 | connection |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of washing fabric articles in a continuous tunnel washer, comprising the steps of:

a) providing a continuous tunnel washer having an interior, an intake, a discharge, and a plurality of sectors that divide the interior into a plurality of zones;

b) moving the fabric articles from the intake to first and second of said sectors that are pre-wash zones;

c) counter flowing liquid in the washer interior along a flow path that is generally opposite the direction of travel of the fabric articles;

d) transferring the fabric articles to a main wash zone;

e) adding a washing chemical to the main wash zone;

f) stopping counter flow during step "e" to provide a standing bath for a selected time interval that is sufficient in length to enable the added chemicals to separate soils from the fabric articles and suspend the soils in the standing bath;

g) commencing counter flow after step "f" to provide a rinse that rinses the washing chemicals and suspended soils from the fabric articles; and h) using an extractor to remove excess water from the fabric articles after step "g".

2. The method of claim 1 further comprising adding a fluid to the extractor in step "h".

3. The method of claim 1 further comprising the step of heating the main wash zone before step "g".

4. The method of claim 1 further comprising transferring heat to the main wash zone in step "f".

5. The method of claim 1 wherein counter flow is stopped in step "f" for a time period that is less than about five minutes.

6. The method of claim 1 wherein counter flow is stopped in step "f" for a time period that is less than about three minutes.

7. The method of claim 1 wherein counter flow is stopped in step "f" for a time period that is less than about two minutes.

8. The method of claim 1 wherein counter flow is stopped in step "f" for a time period of between about twenty and one hundred twenty (20-120) seconds.

9. A method of washing fabric articles in a continuous batch washer, comprising the steps of:

a) providing a washer having an interior, an intake, a discharge, and a plurality of sectors;

b) moving the fabric articles from the intake to one or more sectors;

c) counter flowing liquid in the washer interior along a flow path that is generally opposite the direction of travel of the fabric articles in step "b";

d) transferring the fabric articles to a main wash zone that is downstream from the intake;

e) adding a washing chemical to the main wash zone;

f) stopping counter flow during step "e" to provide a standing bath for a selected time interval that is sufficient in length to enable the added chemicals to separate soils from the fabric articles and suspend the soils in the standing bath;

g) commencing counter flow after step "f" to provide a rinse that rinses the washing chemicals and suspended soils from the fabric articles; and h) extracting excess water from the fabric articles after step "g".

10. The method of claim 9 further comprising adding rinse water in step "h".

11. The method of claim 9 further comprising the step of heating the main wash zone before step "g".

12. The method of claim 9 further comprising transferring heat to the main wash zone in step "f".

13. The method of claim 9 wherein counter flow is stopped in step "f" for a time period that is less than about five minutes.

14. The method of claim 9 wherein counter flow is stopped in step "f" for a time period that is less than about three minutes.

15. The method of claim 9 wherein counter flow is stopped in step "f" for a time period that is less than about two minutes.

16. The method of claim 9 wherein counter flow is stopped in step "f" for a time period of between about twenty and one hundred twenty (20-120) seconds.

17. The method of claim 9 wherein in step "f" the added washing chemical is heated to a temperature of between about 140 and 190 degrees Fahrenheit.

18. A method of washing fabric articles in a continuous tunnel washer, comprising the steps of:

a) providing a continuous tunnel washer having an interior, an intake, a discharge, and a plurality of sectors that divide the interior into a plurality of zones;

b) moving the fabric articles from the intake to a pre-wash zone;

c) counter flowing liquid in the washer interior along a flow path that is generally opposite the direction of travel of the fabric articles;

d) after step "b", transferring the fabric articles to a main wash zone;

e) stopping the counter flow of liquid of step "c" after step "d" to provide a standing bath for a selected time interval;

f) adding a washing chemical to the main wash zone, wherein the selected time interval is sufficient in length to enable the added chemicals to separate soils from the fabric articles and suspend the soils in the standing bath;

g) resuming the counterflow after a selected time period after step "f" to provide a rinse that rinses the washing chemicals and suspended soils from the fabric articles; and h) using an extractor to remove excess water after step "f".

19. A method of washing fabric articles in a continuous tunnel washer, comprising the steps of:

a) providing a continuous tunnel washer having an interior, an intake that enables intake of fabric articles, a discharge that enables discharge of fabric articles, and a plurality of sectors;

b) moving the fabric articles from the intake to one or more sectors and in a direction that is generally from the intake toward the discharge;

c) counter flowing liquid in the washer interior along a flow path that is generally opposite the direction of travel of the fabric articles of step "b";

e) adding a volume of a washing chemical to the tunnel washer at a position that is downstream of the intake;

f) stopping the counter flow of liquid after the addition of said volume of washing chemical to provide a standing bath for a selected time interval that is sufficient in length to enable the added chemicals to separate soils from the fabric articles and suspend the soils in the standing bath;

g) commencing counter flow of liquid after step "f" and after the selected time interval to provide a rinse that rinses the washing chemicals and suspended soils from the fabric articles.

20. The method of claim 19 further comprising the step of heating the main wash zone.

21. The method of claim 19 further comprising transferring heat to the main wash zone in step "f".

22. The method of claim 19 wherein counter flow is stopped in step "f" for a time period that is less than about five minutes.

23. The method of claim 19 wherein counter flow is stopped in step "f" for a time period that is less than about three minutes.

24. The method of claim 19 wherein counter flow is stopped in step "f" for a time period that is less than about two minutes.

25. The method of claim 19 wherein counter flow is stopped in step "f" for a time period of between about twenty and one hundred twenty (20-120) seconds.

26. A method of washing fabric articles in a continuous tunnel washer, comprising the steps of:

a) providing a continuous tunnel washer having an interior, an intake, a discharge, and a plurality of modules;

b) moving the fabric articles from the intake to one or more modules that define a main was zone;

c) counter flowing liquid in the washer interior along a flow path that is generally opposite the direction of travel of the fabric articles in steps "a" and "b";

d) adding a volume of a washing chemical to the main wash zone;

e) stopping counter flow after said volume has been added to provide a standing bath for a selected time interval that is sufficient in length to enable the added chemicals to separate soils from the fabric articles and suspend the soils in the standing bath;

f) commencing counter flow after step "e" and after a selected time period to provide a rinse that rinses the washing chemicals and suspended soils from the fabric articles; and g) using an extractor to remove excess water after step "f".

27. The method of claim 26 further comprising the step of heating the main wash zone before step "g".

28. The method of claim 26 further comprising transferring heat to the main wash zone in step "e".

29. The method of claim 26 wherein counter flow is stopped in step "e" for a time period that is less than about five minutes.

30. The method of claim 26 wherein counter flow is stopped in step "e" for a time period that is less than about three minutes.

31. The method of claim 19 wherein counter flow is stopped in step "e" for a time period that is less than about two minutes.

32. The method of claim 26 wherein counter flow is stopped in step "e" for a time period of between about twenty and one hundred twenty (20-120) seconds.

33. The method of claim 1, wherein the extractor is a press.

34. The method of claim 1, wherein the extractor is a centrifugal extractor.

35. The method of claim 18, wherein the extractor is a press.

36. The method of claim 18, wherein the extractor is a centrifugal extractor.

37. The method of claim 26, wherein the extractor is a press.

38. The method of claim 26, wherein the extractor is a centrifugal extractor.

* * * * *